United States Patent [19]

Heckman et al.

[11] Patent Number: 4,852,271

[45] Date of Patent: Aug. 1, 1989

[54] PREHEAT OVEN FOR GLASS CONTAINERS

[75] Inventors: Russell W. Heckman, Perrysburg; Robert C. Miller, Whitehouse; George A. Nickey, Maumee, all of Ohio

[73] Assignee: Owens-Illinois Glass Container Inc., Toledo, Ohio

[21] Appl. No.: 164,296

[22] Filed: Mar. 4, 1988

[51] Int. Cl.[4] ..... F26B 25/00

[52] U.S. Cl. ..... 34/105; 432/124

[58] Field of Search ..... 34/104, 105, 107; 432/120, 122, 124, 126

[56] References Cited

U.S. PATENT DOCUMENTS 2,335,618 11/1943 Thompson ..... 34/105

*Primary Examiner*—Henry A. Bennet

[57] ABSTRACT

An oven for preheating glass containers in which the containers are moved through the oven on a conveyor with the conveyor moving at a linear speed that is in excess of the permitted speed of the container movement. This permits the containers to produce a "gear effect" rotation of the containers that are guided on the conveyor by side rails that are spaced apart a distance greater than the container diameter. A source of heated air is directed against the shoulder of the container by an adjustable nozzle and another nozzle is directed against the heel so that these areas of the container will be preheated so that the shrinking of a plastic label about the container will be uniform.

7 Claims, 4 Drawing Sheets

PREHEAT OVEN FOR GLASS CONTAINERS

BACKGROUND OF THE INVENTION

The application of heat-shrinkable plastic labels to bottles and the subsequent movement of the bottles through a heat-shrink oven has been the subject of a number of issued patents and pending patent applications.

For example, U.S. Pat. No. 3,802,942, dated Apr. 9, 1974, discloses the process of forming a sleeve from a supply of heat-shrinkable, foamed polystyrene and assembling the sleeve over the body of a glass container with the subsequent movement of the container through an oven to heat-shrink the sleeve into conforming relationship to the container. The sleeve may be preprinted and serves as the label for the container. It should be noted that the necessity of preheating the bottle is explained and that the container, which is supported by its neck, first passes through a preheat oven before having the sleeve applied thereto. The sleeve is formed by heat sealing its overlapping ends.

In another U.S. Pat. No. 4,671,843, dated June 9, 1987, a strip of heat-shrinkable, label material is applied in a wraparound manner to the bottles with the body of the bottle serving as the mandrel for forming the sleeve on the bottle. In this patent the subsequent passage of the bottle through a shrink oven completes the formation of a label that is heat-shrunk about the bottle side wall between the heel and shoulder thereof. The overlapping ends of the label are sealed to each other by the use of a solvent for the plastic of the label.

It has been found that in those situations where the bottles are used as the mandrel as in the case of U.S. Pat. No. 4,671,843, the subsequent heat-shrinkage of the label is not satisfactory where more than a 20% shrinkage of the label is required. When more than a 20% shrinkage was required, as is the case with the "family size" container, wrinkles would appear due to uneven shrinkage of the label.

With the foregoing in view, it is an object of the present invention to provide an effective preheat system for the glass bottles before the shrink labels are formed thereon so that a wrinkle-free label will be formed.

It is an additional object of this invention to provide a preheat system for glass containers which is relatively simple in its operation and effective to preheat the bottles from 100° F. to 140° F. while being fed at a rate of up to 600 bottles per minute with at least a 90° rotation of the bottles during the preheat operation.

Other and further objects will be apparent from the following description taken in conjunction with the annexed sheets of drawings.

DETAILED DESCRIPTION OF THE DRAWINGS

Figure 1:
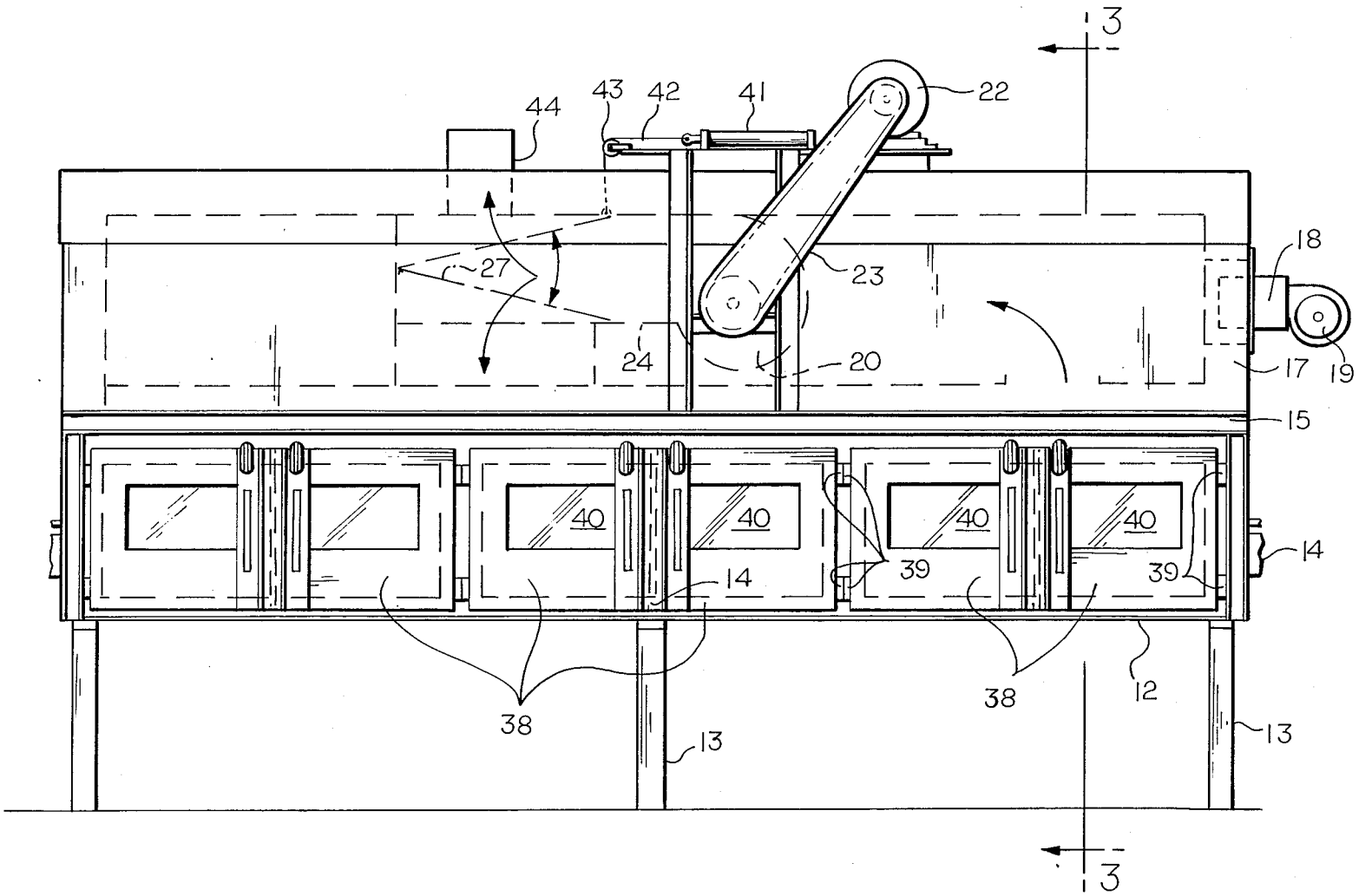
FIG. 1 is a side elevational view of the preheat oven of the invention.
Figure 2:
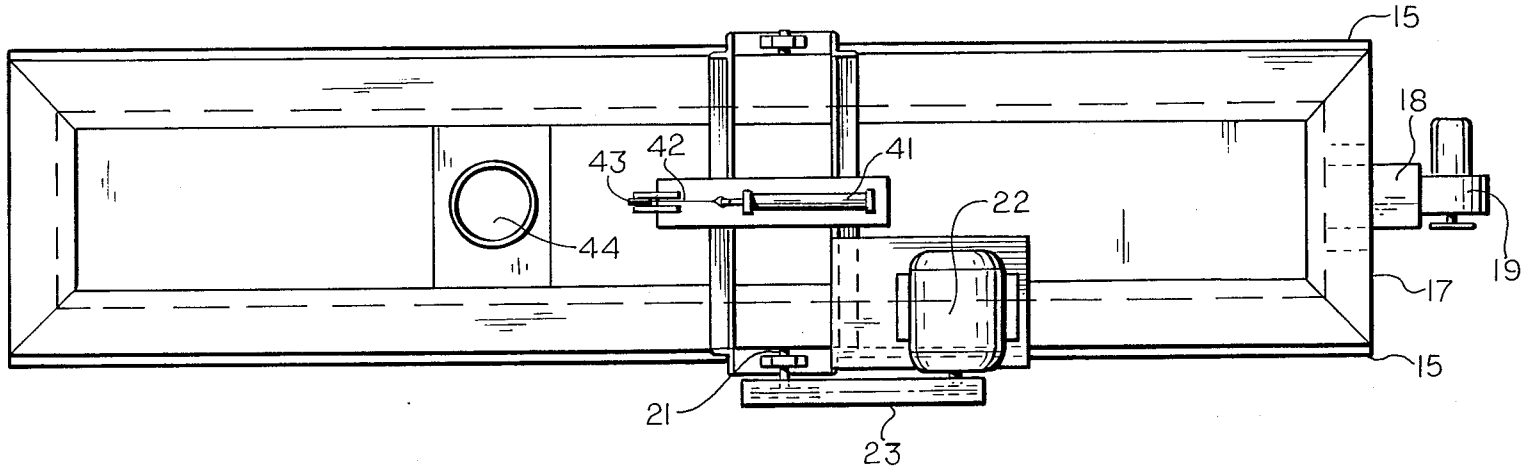
FIG. 2 is a top plan view of the oven of FIG. 1.

The glass container preheater illustrated in the drawings generally is deemed to be a necessary adjunct for the bottle labeling system described in U.S. Pat. No. 4,671,843 in those cases where the label shrinkage must be 20% or greater. This is the case when the bottles are the typical family size beverage bottles or of a contour requiring a label shrinkage of more than 20%.

In the operation of the label applicating and heat-shrink system set forth in the above U.S. Pat. No. 4,671,843, the system speed is in the order of up to 600 bottles per minute and it is important when labeling the larger bottles that they be preheated to a temperature in the range of 100° F. to 140° F. at the labeling speeds.

Figure 3:
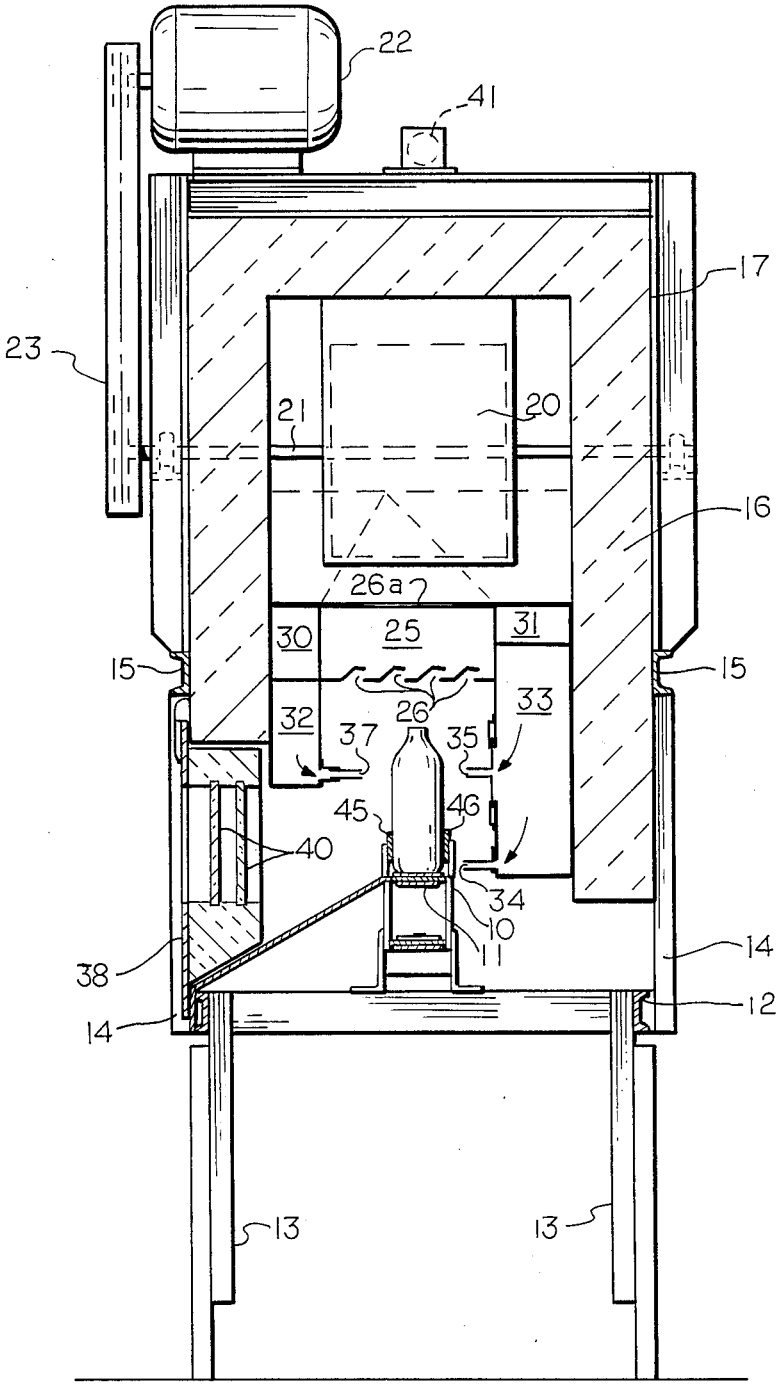
FIG. 3 is a cross-sectional view taken at line 3-3 of FIG. 1.

With the foregoing in mind, the container preheater of the invention comprises a generally horizontal conveyor 10 having a supporting surface 11 that is moving to the right as viewed in FIG. 1. The conveyor is supported by a series of underlying frame members 12 that extend the length of the oven at the sides and at right angles to the conveyor 10 at the ends and in the center. The frame 12 is supported by a plurality of legs 13, only a portion of which are shown. Supported above the frame 12 by vertical channel iron members 14 is a generally horizontal rectangular frame 15 also formed of channel iron. The frame 15 surrounds and supports an inverted "U" -shaped tunnel 16 that extends thereabove and which is formed of heat insulating material. As best shown in FIG. 3, the tunnel which, in effect, resembles an inverted, rectangular box, has an outer sheet metal covering 17.

The tunnel 16 forms an elongated channel extending from the right, as viewed in FIG. 1, and a gas burner 18 extends through the right hand wall. A blower 19 is mounted on the burner and the combination of burner and blower serves to provide a gas flame that extends into the channel of the tunnel.

Approximately mid-way of the length of the tunnel and in the center thereof, there is positioned a centrifugal blower 20. The blower 20 has a horizontal shaft 21 extending through the center thereof, which shaft is driven by an electric motor 22 mounted on the top of the oven. A shroud 23 covers the drive pulleys and belt which is used to drive the blower 20. Air and heated gases enter the blower 20 from the sides and are propelled through the blower outlet 24. Beneath the blower and extending the full length of the oven is a return air plenum chamber 25. The plenum chamber 25 has an opening **26*a* in its top adjacent the right end of the oven through which return air enters the tunnel 16 in advance of the blower 20. The plenum chamber 25 is formed with a plurality of openings 26 in the bottom thereof. These openings 26** are actually formed as semicircular cuts in the wall with the cutouts being bent upwardly to form the openings. The area above the conveyor and the bottles is the source of the return air, as well as some air that will enter the oven from the open ends.

Figure 4:
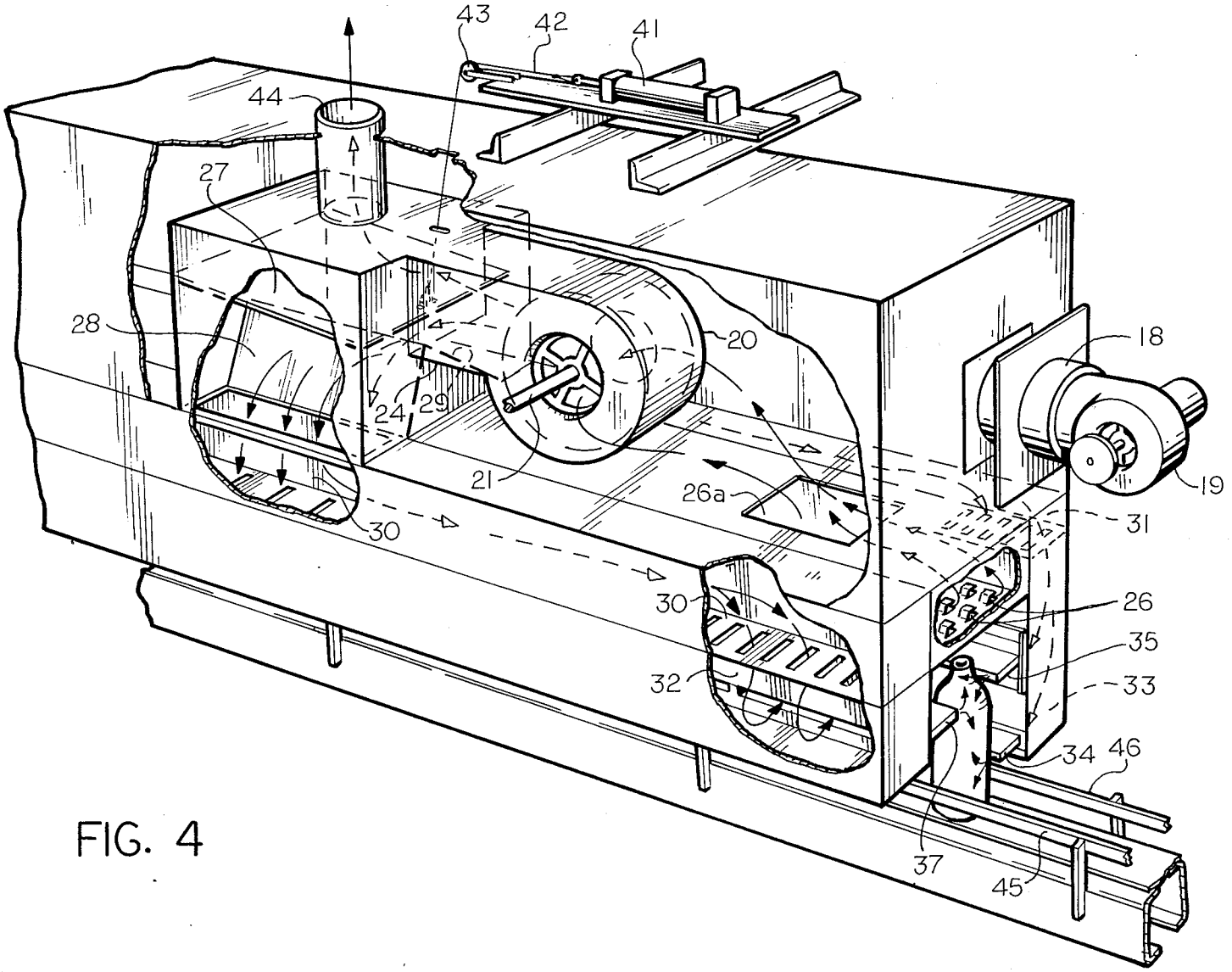
FIG. 4 is a schematic perspective view of the preheater of FIG. 1 with the outer shroud removed.

The heated air that exits the blower 20 encounters a hinged plate 27 which serves as a damper valve. With the plate 27 in its normal position when the system is operating, 90% of the heated air will leave the blower exit 24 and impinge on the bottom of the plate and be deflected downwardly and toward both sides of the tunnel 16. A pair of plates 28 and 29, which form an inverted "V" -shaped deflector, serve to direct the heated air downwardly into the open tops of distributing ducts 30 and 31 which extend along either side of the plenum chamber 25. As best seen in FIGS. 3 and 4, the heated air that is deflected downward at either side thereof enters the ducts 30 and 31 and will flow there-through and into vertical ducts 32 and 33 positioned on opposite sides of the path of travel of bottles "b" through the oven. In actual practice the duct 33, to the right side as viewed in FIG. 3, may be a single chamber that extends the full length of the oven This duct is generally rectangular in cross-section, and at its lower left hand corner is provided with a horizontally extending first nozzle or outlet 34 which is positioned to be essentially adjacent or opposite the heel of a bottle or container carried on the container. This nozzle 34 will direct heated air at the heel of the container to effectively preheat this lower or critical heel position of the container.

Above the nozzle 34, but in the wall of the duct facing the bottles, is a second nozzle 35. The nozzle 35 is positioned at the height of the shoulder of the container or bottle. It should be understood that the nozzle 35 may be mounted on a swivel base so that its direction can be changed for various bottle heights. With a swivel that permits vertical angular adjustment, the critical shoulder area of the bottles ma be directly impinged with the hot air. An alternative system for providing a variable height adjustment to the nozzle 35 would be the replacement of the nozzle that comes from the center of its mounting plate 36 that overlies the opening in the duct 33, with a plate that has the nozzle 35 at the bottom or top or even at an angle, would direct the air at the shoulder. The plate 36 could be mounted in a horizontal slideway and be removed, pulling from one end and replaced by another plate.

The duct 30 opens downwardly into the vertical duct 32 as shown in FIG. 3. In actual practice there are three ducts 32 that collectively span the length of the oven. The ducts 32, at their lower right-hand corner, are provided with an air directing nozzle 37 that is positioned at the height of the shoulder of the bottle in opposition to the nozzle 35. The duct 32 may be replaceable in sections by access through the three sets of doors 38 that are hinged at 39 to the side of the oven. As can be seen in FIG. 3, the doors 38 are fairly thick with insulation and with a pair of windows 40 held therein for observing the operation of the oven from the outside.

As long as bottles are being fed from the oven to the label-applicating system, the oven will be functioning to preheat the containers in the shoulder and heel areas.

The temperature of the heated air that impinges on the bottles may be at 700° F. and thus it is important that, if the flow of containers through the oven is interrupted for any reason, it is important that the bottles not be permitted to sit in the heated atmosphere for any extended period. For one thing, if the bottles become too hot and are later exposed to the shrink labels, the labels will shrink prematurely and cause wrinkles in the label or result in the label not being completely wrapped around the bottles.

The labeling machine, which is to receive the preheated glass bottles, is that described in U.S. Pat. No. 4,671,843, dated June 9, 1987, of common assignee, although the present invention would have application as a preheat oven for any labeling machine that is to apply shrink labels to glass containers.

With the foregoing in mind, it is significant that in actual practice the present preheat oven is connected to the control system for the label applicating machine so that when the applicating machine is stopped, a signal will be transmitted to the preheat oven. This signal is in the form of a control signal for operating a fluid motor 41 mounted on the top of the oven. The motor 41 is a reciprocating piston motor that has its piston rod connected to a cable 42 that extends horizontally over a pulley 43 and then downwardly through an opening in the top of the oven with its lower end connected to the plate 27.

When the motor control receives the signal that the labeling machine has stopped with the resultant stoppage of bottles out of the preheat oven, the motor 41 will operate to drop the hinged plate under its own weight to the lowered position illustrated in dot-dash line in FIG. 1. When the plate has dropped, the heated air from the blower 20 and the tunnel 16 will be diverted upwardly into an exhaust stack 44. As a consequence of the dropping of the damper plate 27, the blower 20 will continue to draw air from the plenum chamber 25 through the opening 26. This air, however, will not be heated because it comes from the area immediately above the bottles. Since no hot air is being directed against the bottles, the bottles will not become overheated, but when the system begins to function again the air cylinder 41 will raise the plate 27 and the hot air will once again impinge on the containers from the nozzles 34, 35 and 37.

While in the foregoing description the ducts 32 are replaceable with ones of different height, it is considered an alternative system where the ducts 32 are actually formed of two telescoping vertical sections, where the bottom section may be vertically adjusted by the operator through access through the doors.

Along the side of the conveyor 10, at a position about mid-height of the bottle side walls, there are a pair of opposed rails 45 and 46. These rails are spaced apart a distance which is $1\frac{1}{4}$ to $1\frac{1}{2}$ times the diameter of the bottles to be preheated so that the bottles will be confined generally to a single file, but the bottle movement is by contact of the bottle at the back pushing the bottle in front of it with the bottle in front being confined by either the railing 45 or 46.

It should be noted that there is no specific provision for rotating the bottles; however, it was determined through experimentation and operation of the system that, by having the bottles in bottle-to-bottle contact when being conveyed through the oven, with the conveyor moving somewhat faster than the bottles are permitted to pass through the oven, the rubbing of the bottles against each other and against the spaced apart side rails 45, 56 will result in the precession of the bottles in a sort of "gear-effect" which causes the bottles to rotate and the heat will then be applied circumferentially of the bottles as they pass through the oven. In order to protect the bottles from thermal shock by contact with the rails, the rails 45, 46 may be covered with a heat resistant material, such as Applon Insulation, which is also a wear resistant material, sold under the designation DG 1160 PC by Applied Plastics Corp. of Tuscumbia, Ala.

It should be kept in mind that the oven is actually formed of three four-foot long sections. This is shown in FIG. 1 where the side view illustrates three hinged access doors 38 which extend along the one side of the oven structure. Obviously, this section could be made in one piece; however, it is somewhat easier to handle smaller sections when assembling the system and making the necessary adjustments to the height of the air impingement nozzles that are directed toward the bottles on the conveyor.

While the temperature of the heated air may be in the order of 700° F., it may be within the range of 300° F.–800° F., depending upon the shape of the bottle and the degree of shrinkage needed at the heel and shoulder of the bottle.

Having described the best mode contemplated by the inventor in carrying out the invention, other modifications may be resorted to within the scope of the appended claims.

What is claimed:

1. A preheat oven for heating glass containers at selected vertical zones prior to the application of a roll-on, heat-shrinkable label thereto, said oven comprising, a linear, horizontal moving conveyor extending the length of the oven for supporting a succession of containers with their axes vertical, a pair of opposed, stationary side rails extending along the length of said conveyor, said side rails being spaced apart a distance greater than a single container diameter but not greater than 1½ container diameters, a source of heated air at a temperature of 300° F.–800° F., said source being above the conveyor, duct means extending from said source to along at least one side of the containers on said conveyor, nozzle means carried at the lower edge of said duct for directing heated air against the shoulders of said containers for heating the containers to 100° F. to 140° F., said containers engaging each other and the side rails during their linear movement through said oven to thereby rotate the containers about their vertical axes to heat the containers about their circumference.

2. The preheat oven of claim 1 wherein said side rails are spaced apart between 1¼ and 1½ diameters of the containers being preheated.

3. The preheat oven of claim 1 wherein the temperature of said heated air is maintained at 700° F.

4. The preheat oven of claim 1 wherein at least one of said ducts is vertically adjustable relative to the conveyor for accommodating containers of differing shoulder height.

5. The preheat oven of claim 4 further including a second duct positioned on the opposite side of the containers from said at least one duct, said second duct having a nozzle at the lower end thereof that is directed at the heel of containers on said conveyor.

6. The preheat oven of claim 5 further including a second nozzle extending from said second vertical duct, said second nozzle being mounted to said duct for vertical swivel movement about a horizontal axis, said second nozzle being directed at the shoulder of the containers.

7. The preheat oven of claim 1 further comprising, means for monitoring the movement of containers through said oven and means connected to said monitoring means for diverting said hot air to an exhaust stack when said monitoring means detects stoppage of movement of containers through said oven.

* * * * *